US005717183A

United States Patent [19]

Lehmann et al.

[11] Patent Number: 5,717,183

[45] Date of Patent: Feb. 10, 1998

[54] HIGH-VOLTAGE POWER SWITCH WITH A COOLING DEVICE FOR COOLING THE QUENCHING GAS

[75] Inventors: Volker Lehmann, Treuenbrietzen; Heiner Marin; Friedrich Löbner, both of Berlin, all of Germany

[73] Assignee: Siemens Aktiengesellschaft, München, Germany

[21] Appl. No.: 619,545

[22] PCT Filed: Aug. 22, 1994

[86] PCT No.: PCT/DE94/00988

§ 371 Date: May 24, 1996

§ 102(e) Date: May 24, 1996

[87] PCT Pub. No.: WO95/08834

PCT Pub. Date: Mar. 30, 1995

[30] Foreign Application Priority Data

Sep. 24, 1993 [DE] Germany ..... 9314779 U

[51] Int. Cl.[6] ..... H01H 33/82

[52] U.S. Cl. ..... 218/90; 218/57

[58] Field of Search ..... 218/51, 57, 60, 218/85, 89, 90, 156, 157

[56] References Cited

U.S. PATENT DOCUMENTS

| | | | |
|---|---|---|---|
| 3,544,747 | 12/1970 | Boersma . | |
| 3,814,883 | 6/1974 | Milianowicz | 218/85 |
| 4,149,051 | 4/1979 | Millianowicz . | |
| 4,328,403 | 5/1982 | Frink et al. . | |
| 4,684,773 | 8/1987 | Niemeyer | 218/46 |
| 4,749,831 | 6/1988 | Hosomi et al. | 218/57 |
| 4,935,590 | 6/1990 | Malkin et al. | 218/57 |
| 5,159,164 | 10/1992 | Koyanagi et al. | 218/62 |

FOREIGN PATENT DOCUMENTS

| | | |
|---|---|---|
| 218 496 | 6/1985 | German Dem. Rep. . |
| 18 89 068 | 1/1964 | Germany . |
| 24 11 836 | 9/1975 | Germany . |
| 29 47 957 | 12/1980 | Germany . |
| 23 24 125 | 12/1981 | Germany . |
| 30 09 504 | 8/1990 | Germany . |
| 39 15 700 | 11/1990 | Germany . |
| 93 14 779 | 11/1993 | Germany . |
| 401 203 | 4/1996 | Switzerland . |

OTHER PUBLICATIONS

Johnson, et al., Development of the Type 145 PM Self-Blast Circuit Breaker, 1991, pp. 1–10.

*Primary Examiner*—Stuart N. Hecker
*Attorney, Agent, or Firm*—Kenyon & Kenyon

[57] ABSTRACT

An electric high-voltage power switch has two contacts and at least one gas outlet for quenching gas heated by the arc generated between the contacts. A cooling device is provided for cooling the quenching gas. The cooling device is formed of a metal body with through-holes arranged in the flow path of the quenching gas. An insulating component impermeable to the quenching gas, is fitted in the gas outlet in front of the metal body viewed from the contacts and consists of a material (PTFE) releasing a quenching gas at high temperatures. The insulating component is sufficiently distanced from the metal body for the quenching gas to be able to pass through the through-holes substantially over the entire surface of the metal body.

5 Claims, 1 Drawing Sheet

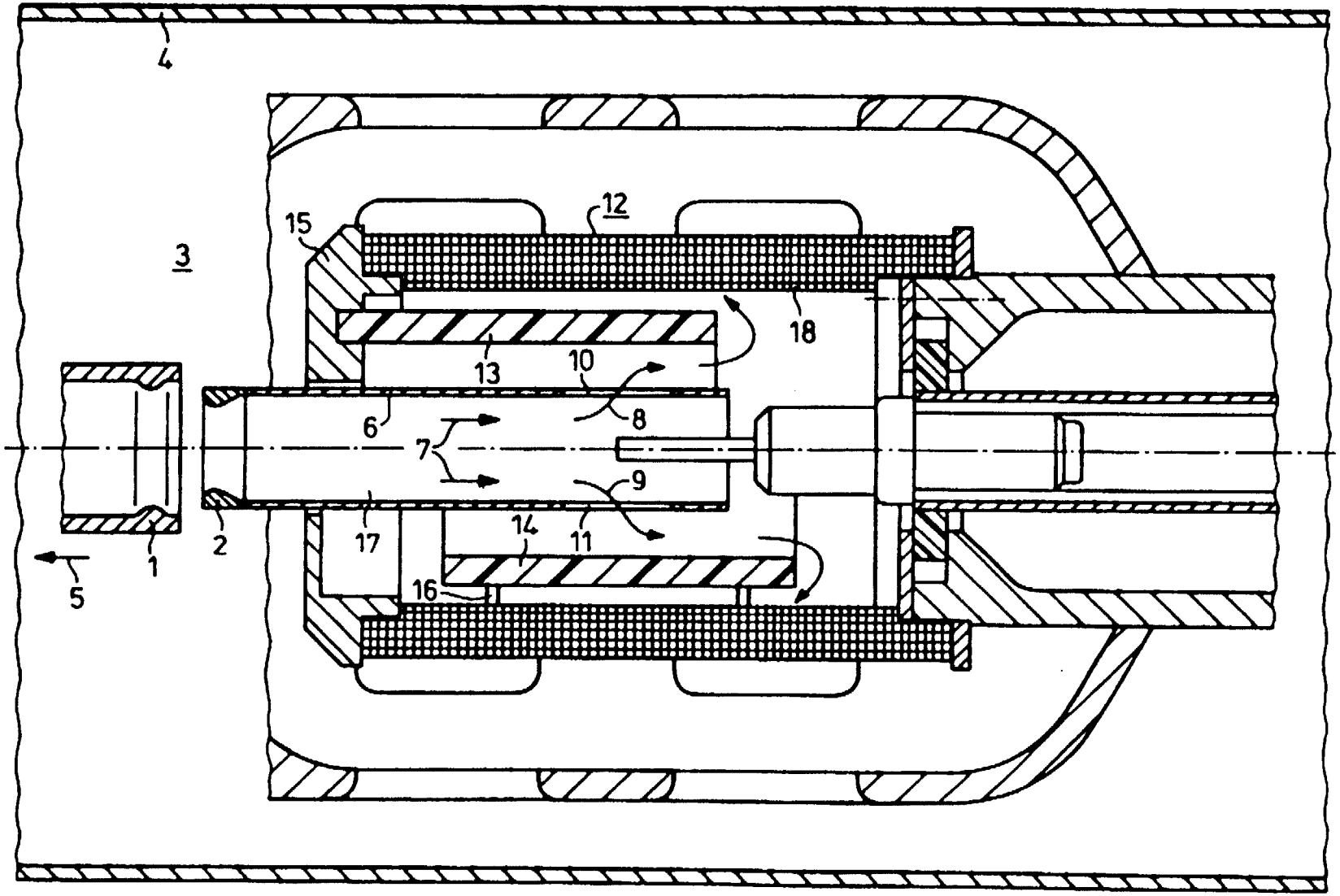
1
2
3
4
5
6
7
8
9
10
11
12
13
14
15
16
17
18

HIGH-VOLTAGE POWER SWITCH WITH A COOLING DEVICE FOR COOLING THE QUENCHING GAS

FIELD OF THE INVENTION

The present invention relates to a high-voltage power switch with two contacts and at least one gas outlet for quenching gas heated by the arc generated between the contacts, and a cooling device for cooling the quenching gas, consisting of a metal body with through-holes arranged in the flow path of the quenching gas.

BACKGROUND OF THE INVENTION

Such a high-voltage power switch is known, for example, from a technical article entitled "Development of the type 145 pm self-blast circuit breaker." In the power switch described there, a metal body shaped as a hollow cylinder is shown in the region of the circuit breaker unit, consisting of a metal wire braid. The hot quenching gas can pass through the wire braid and is cooled in the process, which results in rapid dielectric reinforcement of the isolating distance.

Also, DE-U-18 89 068 discloses a high voltage power switch with a cooling body in the flow path of a quenching gas.

It has been shown that such a metal body corrodes easily under the influence of the hot quenching gas, i.e. parts of the metal body are vaporized. After such vaporization, hot quenching gas that is subsequently produced can pass through the metal body unhindered and uncooled, and the other parts of the switch can be damaged as a result. Furthermore, the metal vapor that forms during vaporization of the metal body could be deposited on insulation material parts, resulting in a reduction in dielectric strength.

OBJECTS AND SUMMARY OF THE INVENTION

An object of the invention therefore is to provide a cooling device of a high-voltage power switch of the type described above that enables efficient cooling of the quenching gas in a reliable manner, with a longer lifespan of the cooling device.

This object is accomplished, according to the invention, by fitting an insulating component impermeable to the quenching gas in the gas outlet in front of the metal body, viewed from the contacts The insulating component is far enough away from the metal body for the quenching gas to be able to pass through holes substantially over the entire surface of the metal body.

The metal body is protected from the direct effect of the hot quenching gas by the insulating component arranged in front of the metal body. While the insulating component is also attacked by the hot quenching gas, under the influence of the hot quenching gas, it releases a gas that is also suited for quenching, and can easily be replaced. Furthermore, when the insulating component vaporizes, no electrically conductive vapor is released, which could contaminate other insulating components in the region of the circuit-breaker unit and thus result in a reduction in dielectric strength. By spacing the insulating component away from the metal body, the result achieved is that on the one hand, the hot quenching gas does not hit the metal body directly, and that on the other hand, the quenching gas can flow away through the entire cross-section of the through-holes in the metal body, passing around the insulating component, after it has hit the insulating component. The invention is advantageously structured in that the insulating component consists of PTFE.

This material has particular thermal stability and, under the influence of the hot quenching gas, gives off gases that themselves can make an effective contribution to quenching the switch arc, i.e. to reinforcing the isolating distance.

Another advantageous further development of the invention provides that the metal body is structured as a hollow cylinder and that the insulating component is structured as a ring-shaped element inside the metal body.

This design is particularly simple. The hot quenching gas which gets inside the hollow cylinder can flow out towards the outside through the metal body, after having interacted with the insulating component. All that is necessary for this is for two elements, namely the metal body and the insulating component, to be attached into each other.

The insulating component can have recesses in regions not impacted by hot quenching gas or can also consist of several blocks that are arranged in front of the metal body at the locations that are under particular stress due to the hot quenching gas.

The invention can furthermore be advantageously implemented in that the insulating component is connected with one end of the metal body so as to support it.

It furthermore proves to be advantageous that one of the contacts is connected with a contact pipe, structured to be hollow so as to draw off the quenching gases, which pipe passes through at least part of the metal body and has radial openings for the quenching gas in the region of the metal body, and that the insulating component is arranged between the contact pipe and the metal body in the region of the radial openings.

The contact and the contact pipe as well as the insulating component and the metal body can therefore be put together into a design entity in simple manner, which entity takes little space in the housing of a power switch. Furthermore, the metal body offers the quenching gas a high passage cross-section. It is advantageous if the metal body consists of a wire braid, for example, particularly made of copper wire.

In the following, the invention is shown using an exemplary embodiment in a drawing, and subsequently described.

BRIEF DESCRIPTION OF THE DRAWING

The figure is a cross-section view of a part of a circuit breaker unit including a power switch in accordance with the present invention.

DETAILED DESCRIPTION

In this drawing, the figure shows part of a circuit-breaker unit schematically, in two half-sections. The figure schematically shows a power switch with two contacts 1, 2, shown schematically. The circuit-breaker unit 3 is arranged in a cylindrical, metallic capsule housing 4. The contact 1 surrounds the contact 2 in the switched-on state. In the switched-off state, the contact 1 is moved away from the contact 2 in the direction of the arrow 5.

During the switching process, an arc is drawn in the region between the contacts 1, 2, which causes the quenching gas, for example $SF_6$, with which the cylindrical capsule housing 4 is filled, to be greatly heated and therefore expanded. The contact 2 is connected with a contact pipe 6, which is hollow in order to draw off the switching gases in the direction of the arrows 7, 8, 9. The contact pipe 6 has radial discharge openings 10, 11 at its end facing away from the contact 2, through which the quenching gas can flow off radially out of the contact pipe 6. Since the quenching gas is very hot after the switching process, it is supposed to be cooled as quickly as possible by being mixed with quenching gas that is not under the influence of the arc, for example in the outside space, in order to achieve rapid reinforcement of the isolating distance between the contacts 1, 2. On the way from the contact pipe 6 to the outside space, the hot quenching gas passes a metal body 12, which consists of a copper wire braid, and in which the hot quenching gas is quickly cooled by interaction with the metal surface. Because of the plurality of through-holes extending through the metal body 12, the flow resistance for the quenching gas is slight.

In order to prevent the metal body 12 from being partially corroded, i.e. vaporized by the direct effect of the hot quenching gas, a ring-shaped insulating component made of PTFE (polytetrafluoroethylene) is arranged between the exit openings 10, 11 and the metal body 12, which the hot quenching gas hits first, before it reaches the metal body 12. When the hot quenching gas hits the insulating component 13, 14, gas is released in the material of the insulating component 13, 14, which gas can also serve to quench the arc.

Only after the quenching gas has been deflected by this insulating component does it flow to the metal body 12.

This means that good swirling of the hot quenching gas also takes place.

The insulating component 13 is attached in a plate 15, which closes off the cylindrical metal body 12 at the end.

The insulating component can be glued on or screwed on there, for example.

It is also possible, however, as shown in the lower half-section, to attach the insulating component 14 directly onto the inside mantle surface of the metal body 12, on stays or individual feet 16. Here again, it is possible to attach it by gluing or screwing it on.

We claim:

1. A high-voltage power switch, comprising:

two contacts for generating an arc therebetween;

at least one gas outlet for receiving quenching gas heated by the arc;

a cooling device for cooling the quenching gas, said cooling device comprising a metal body with through-holes, said metal body arranged in a flow path of the quenching gas; and an insulating component impermeable to the quenching gas, said insulating component fitted in the gas outlet in the flow path of the quenching gas between the metal body and the contacts, and said insulating component being sufficiently spaced from the metal body such that the quenching gas is able to pass through through-holes substantially over the entire surface of the metal body.

2. The high-voltage power switch of claim 1, wherein the insulating component comprises PTFE.

3. The high-voltage power switch of claim 1, wherein the metal body comprises a hollow cylinder and the insulating component comprises a ring-shaped element inside the metal body.

4. The high-voltage power switch of claim 1, wherein the insulating component is connected to one end of the metal body such that said metal body supports said insulating component.

5. The high-voltage power switch of claim 1, wherein one of the contacts is connected to a contact pipe, said contact pipe being hollow for drawing off the quenching gas, said pipe extending through at least part of the metal body and having radial openings for enabling passage of the quenching gas into a region of the metal body, and wherein the insulating component is arranged between the contact pipe and the metal body proximate the radial openings.

* * * * *